US005495731A

United States Patent [19]

Riznik

[11] Patent Number: 5,495,731

[45] Date of Patent: Mar. 5, 1996

[54] MULTIPLE-BOLT DOOR LOCK

[75] Inventor: Peter Riznik, Tillmitsch, Austria

[73] Assignee: Roto Frank Eisenwarenfabrik Aktiengesellschaft, Karlsdorf bei Graz, Austria

[21] Appl. No.: 218,324

[22] Filed: Mar. 25, 1994

[30] Foreign Application Priority Data

Mar. 26, 1993 [AT] Austria ..... 623/93

[51] Int. Cl.[6] ..... E05B 59/00

[52] U.S. Cl. ..... 70/108; 292/39

[58] Field of Search ..... 70/92, 107, 108, 70/120, 123; 292/36, 37, 39, 142

[56] References Cited

U.S. PATENT DOCUMENTS

| | | | |
|---|---|---|---|
| 1,495,820 | 5/1924 | Tierny | 292/36 |
| 1,548,882 | 8/1925 | Hemphill | 70/120 |
| 1,607,038 | 11/1926 | Baron | 70/120 |
| 4,606,203 | 8/1986 | Esser | 70/107 |
| 4,962,653 | 10/1990 | Kaup | 292/39 |
| 5,044,184 | 9/1991 | Herbers | 70/107 |
| 5,193,370 | 3/1993 | Norden | 70/120 |
| 5,265,920 | 11/1993 | Kaup | 70/107 |

FOREIGN PATENT DOCUMENTS

| | | | |
|---|---|---|---|
| 0021820 | 1/1981 | European Pat. Off. | 292/39 |
| 0341173 | 8/1989 | European Pat. Off. . | |
| 0391063 | 2/1990 | European Pat. Off. . | |
| 0454966 | 2/1991 | European Pat. Off. . | |
| 0454960 | 2/1991 | European Pat. Off. | 292/39 |
| 0454959 | 2/1991 | European Pat. Off. | 292/39 |
| 2439282 | 6/1979 | France . | |
| 204858 | 10/1923 | United Kingdom | 70/120 |

*Primary Examiner*—Steven N. Meyers
*Assistant Examiner*—Gary Estremsky
*Attorney, Agent, or Firm*—Herbert Dubno; Andrew Wilford

[57] ABSTRACT

A door lock has a housing adapted to be mounted on an edge of the door, inside and outside nuts rotatable about respective inside and outside axes on the housing, and respective inside and outside handles fixed to the nuts and respectively projecting inward and outward from the door with each handle movable upward and downward from a central position. A pair of bolts in the housing each movable between an outer position and an inner position are coupled to respective slides and movable jointly therewith between a position extended from the door in the outer position of the respective slide and a position recessed in the door in an inner position of the respective slide. An actuating arm on the inside nut can engage stops on one of the slide and a gear train meshes on one side with the outside nut and on the other side with both of the slides for opposite movement of the two slides on rotation of the outside nut. Respective inside and outside lost-motion couplings between the inside nut and the arm and between the outside nut and the gear train permit limited angular movement of the inside and outside nuts without movement of the one slide and gear train. The nuts and handles are urged by springs into the central positions.

10 Claims, 4 Drawing Sheets

MULTIPLE-BOLT DOOR LOCK

FIELD OF THE INVENTION

The present invention relates to a multiple-bolt lock. More particularly this invention concerns such a lock that has a plurality of bolts that are used to secure a door in a door frame.

BACKGROUND OF THE INVENTION

A high-security lock has more than one bolt that is extended from the door edge into the jamb when the door is locked. These bolts are normally actuated by at least one slide that moves in a standard installation vertically and that is either directly connected to a bolt that can emerge from the top and/or bottom edge of the door or through a linkage to a bolt that emerges from the vertical side edge of the door well above and/or below the lock. Thus in order to lock the door by extending these bolts it is necessary to move a substantial amount of mechanism.

In European patent document 1,454,966 such an arrangement is described which is wholly actuated by the key. A step-down transmission is connected between the rotary part of the key cylinder and the bolt slide. Thus the user of the lock must laboriously crank the key around to lock and unlock the door, subjecting the key to a torsion it was not really meant to withstand.

European patent document 2,391,063 has a system where the bolt slide can be operated by the door handle. The inside handle is biased into a central position and is moved in one direction to lock the door and in the opposite direction to open it. When such a lock is provided with a key mechanism it becomes fairly bulky and complex, and when locked it cannot be opened from inside even in an emergency.

OBJECTS OF THE INVENTION

It is therefore an object of the present invention to provide an improved multiple-bolt door lock.

Another object is the provision of such an improved multiple-bolt door lock which overcomes the above-given disadvantages, that is which is relatively compact, which is easy to lock and unlock, which can be unlocked by a key, and which can always be opened from inside, even when locked by the key.

SUMMARY OF THE INVENTION

A door lock has according to the invention a housing adapted to be mounted on an edge of the door, inside and outside nuts rotatable about respective inside and outside axes on the housing, and respective inside and outside handles fixed to the nuts and respectively projecting inward and outward from the door with each handle movable upward and downward from a central position. A pair of bolts in the housing are each movable between an outer position and an inner position and are coupled to respective slides and movable jointly therewith between a position extended from the door in the outer position of the respective slide and a position recessed in the door in an inner position of the respective slide. An actuating arm on the inside nut can engage stops on one of the slides and a gear train meshes on one side with the outside nut and on the other side with both of the slides for opposite movement of the two slides on rotation of the outside nut. Respective inside and outside lost-motion couplings between the inside nut and the arm and between the outside nut and the gear train permit limited angular movement of the inside and outside nuts without movement of the one slide and gear train. The nuts and handles are urged by springs into the central positions.

This construction makes it possible to build the lock very compactly because the handles can move freely back from the locked position into the central starting position. This is facilitated when the inside lost-motion coupling is formed by the stops which are spaced apart by a distance permitting the arm to move through a predetermined angle between a position contacting one of the stops to a position contacting the other stop. The outside lost-motion coupling comprises a radial formation on the outside nut and a ring rotatable on the outside nut and having a pair of angularly spaced stop surfaces engageable with the formation and spaced apart by a distance permitting the formation to move through a predetermined angle between a position contacting one of the stop surfaces and a position contacting the other stop surface. The spacing provides the necessary free travel that so simplifies the construction.

According to another feature of the invention a locking slide can fit with the bolt-actuating slide in a locked position retaining the bolt-actuating slide against movement between its positions. A key-operated cylinder coupled to the locking slide moves it into the locked position. The locking slide is formed with a lateral recess and the cylinder has a cam arm engageable in the recess. This locking slide is also provided with a spring urging the cam arm out of the recess. An emergency-release slide coupled to the inside nut is displaceable by downward pivoting of the inside handle to engage the lock slide and displace it out of the locked position. Thus even when the door has been locked with a key, invariably from outside, the inside handle can still unlock and open it. The emergency-release slide is formed with a laterally open recess and the inside nut has a radially extending arm projecting into this recess. In addition the emergency-release slide has an angled cam edge engageable with the lock slide. An outside lost-motion couplings between the outside nut and the arm permits limited angular movement of the outside nuts without movement of the one slide until the emergency slide has engaged the lock slide and moved it out of the locked position. Thus as the inside handle is actuated it first pulls back the lock slide, then actuates the bolt slide to unlock the door. In fact careful actuation of the inside handle can undo the key lock without retracting the bolts.

A sector gear is formed according to the invention on the inside nut and a displaceable rack meshes with the sector gear. At least one spring braced between the rack and the housing urges the rack into a position corresponding to the central position of the inside handle.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
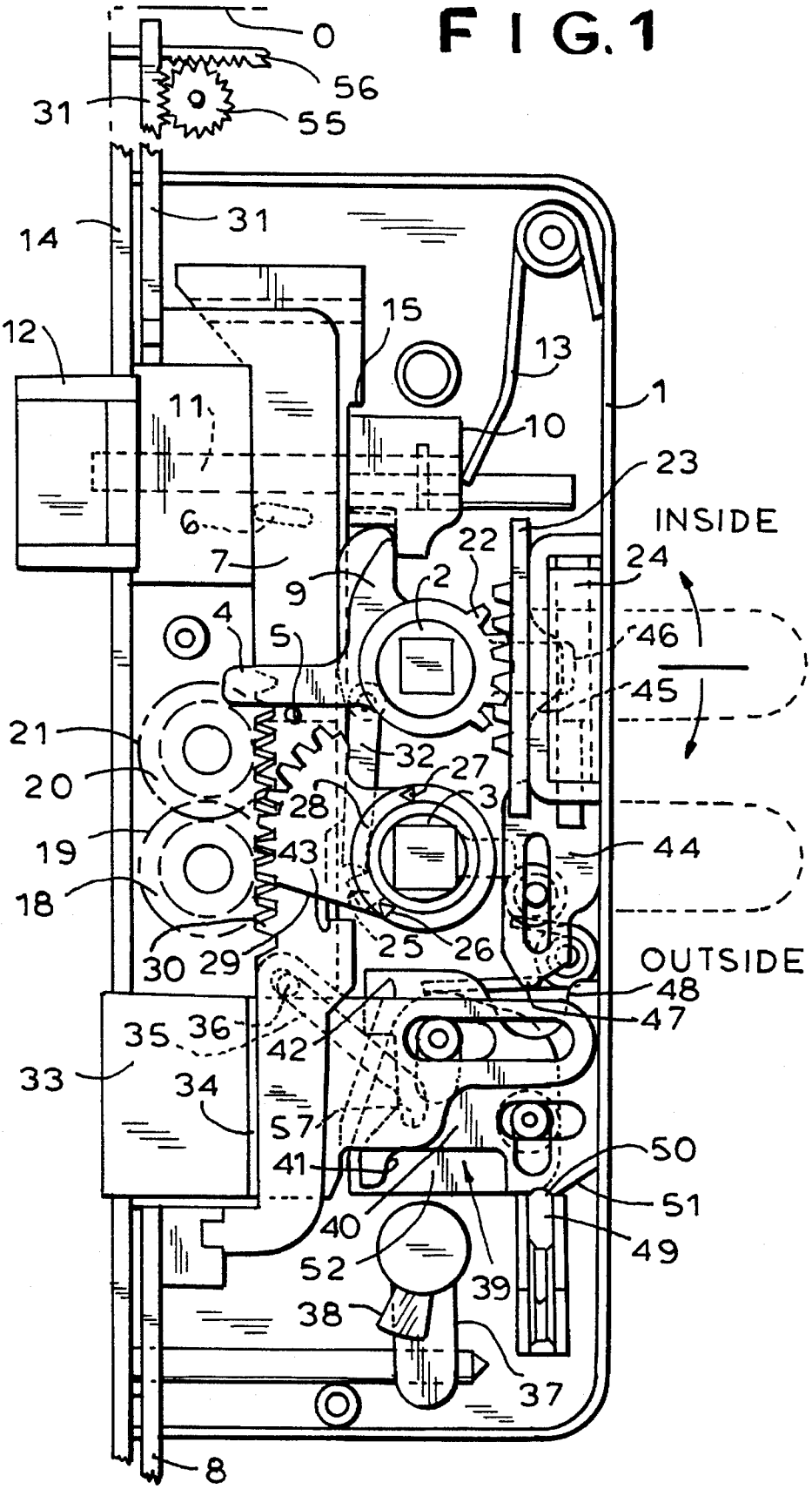
FIG. 1 is a partly diagrammatic vertical section through the lock according to this invention in the unlocked position with the door open.
Figure 2:
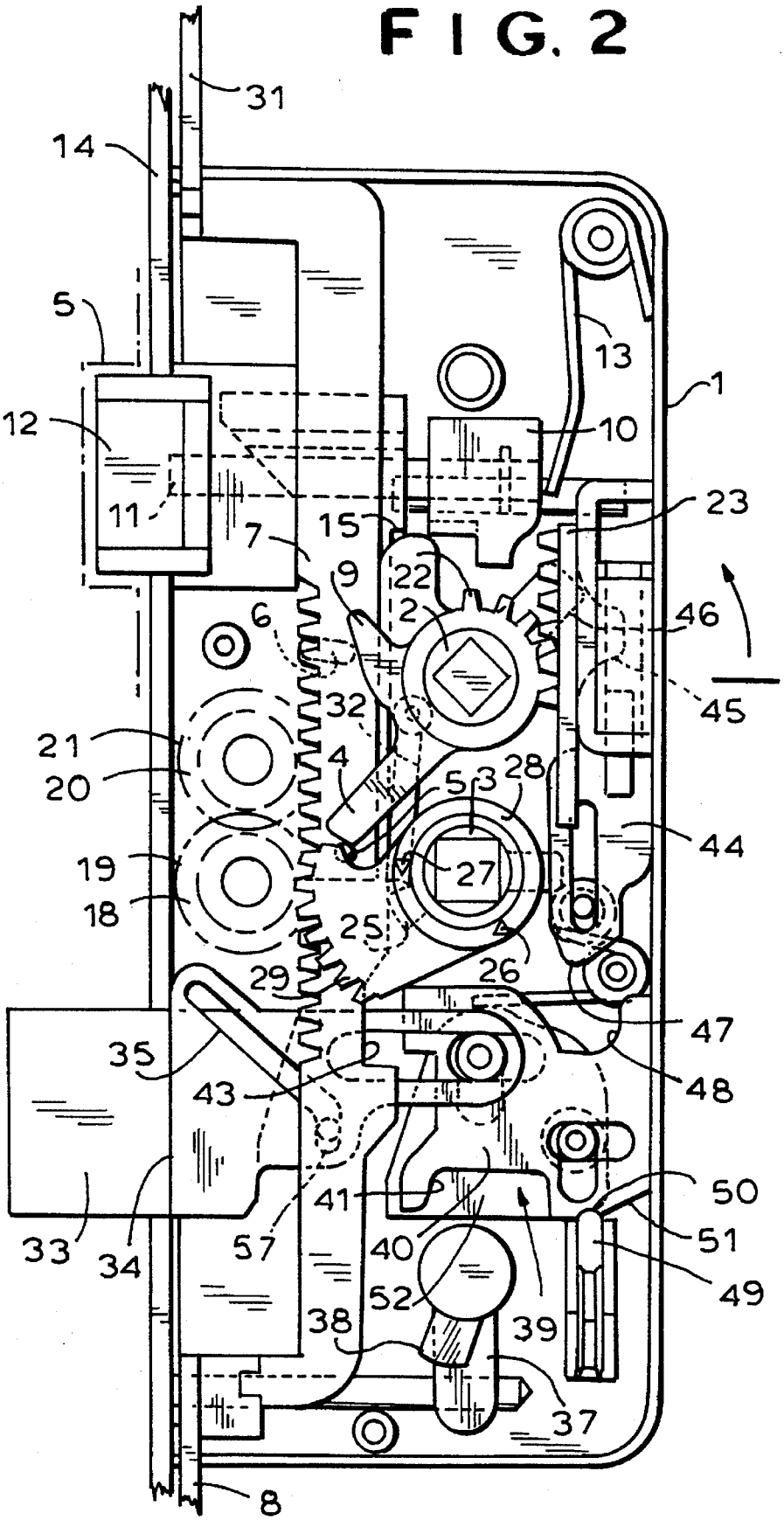
FIG. 2 is the lock of FIG. 1 in the locked position with the inside handle at the upper end of its travel.

As seen in FIG. 1 a lock according to this invention has a housing 1 normally mortised into the edge of a door shown schematically at D which can move relative to a jamb-mounted strike shown schematically at S in FIG. 2. An inside handle nut 2 and an outside-handle nut 3 are rotatable in the housing 1 about parallel axes. The nuts 2 and 3 could be coaxial and axially immediately adjacent one another, forming a so-called split nut.

The inside-handle nut 2 is formed with a radially projecting actuating arm 4 that can engage vertically against lower and upper stops or abutments 5 and 6 formed on a slide 7 which is directly connected to a lower bolt-operating rod 8. Thus if an inside handle shown schematically in phantom lines at 53 is lifted through 45° the arm 4 pushes down on the slide 7 and pushes down the bolt-actuating rod 8. The outer edge of the slide 7 is formed with teeth as a rack that meshes with a gear 19 that is coaxial with and fixed to a gear 18 in continuous mesh with another gear 20 that in turn is coaxial with and fixed to a gear 21 that meshes with a rack formed on the edge of another slide 30 like the slide 7 but connected to an upper bolt-actuating rod 31. The gears 18–21 form a direction-reversing transmission so that when the slide 7 and rod 8 are moved downward, the slide 30 and rod 31 are moved upward. As seen in FIG. 1 the rod 31 is formed in part as a rack meshing with a gear 55 in turn meshing with a rack formed on a bolt 56 that can therefore be extended from the vertical side edge of the door D. The end of the rod 31 is itself formed as a bolt capable of projecting past the upper edge of the door D. Thus when the slides 7 and 8 are moved oppositely apart they extend bolts like the bolt 56 that project horizontally from the vertical side edge of the door and further bolts that project vertically from the top and bottom edges of the door, solidly securing the door at several locations to the door jamb.

The nut 2 further is formed with a radially extending actuating arm 9 that can engage an entrainment element 10 fixed on a rod 11 connected to a side latch bolt 12 that can move horizontally between the illustrated position projecting past the edge of the door D and an unillustrated position wholly withdrawn into the housing 1 set in the door. A spring 13 urges the bolt assembly 10, 11, 12 into the extended position. The slide 7 has a detent shoulder 15 that blocks downward movement of the slide 7 into the locked position when the bolt assembly 10, 11, 12 is fully extended as can only happen when the door D is open. When the bolt 12 is fitted to the shallow strike S it is not fully extended so that the detent 15 clears the element 10. Thus the latch mechanism cannot be moved into the locked position with the door open. This bolt 12 is used merely to hold the door closed when it is not locked, the other above- and below-described bolts are the ones with the major security function against forced entry.

The nut 2 is further formed like a gear wheel with teeth 22 meshing with the teeth of a rack 23 that is upwardly and downwardly movable from the illustrated center position and urged into this center position by one or more springs 24. Thus this spring 24 also urges the inside handle 53 into the center position. The inside handle 53 and nut 2 can, however, move downward through a considerable angular stroke without the arm 4 engaging the stop 6, but any downward push on the inside handle 53 will retract the latch bolt 12. Thus if the door D is merely closed and retained by the bolt 12 only, a simple downward push on the inside handle 53 will open it. The spring or springs 24 urge the nut 2 into a position with the arm 4 resting on the stop 5 and the arm 9 bearing angularly oppositely against the element 10 so that any upward movement of the inside handle 53 will immediately move the slide 7, and any downward movement will immediately retract the bolt 12.

Figure 3A:
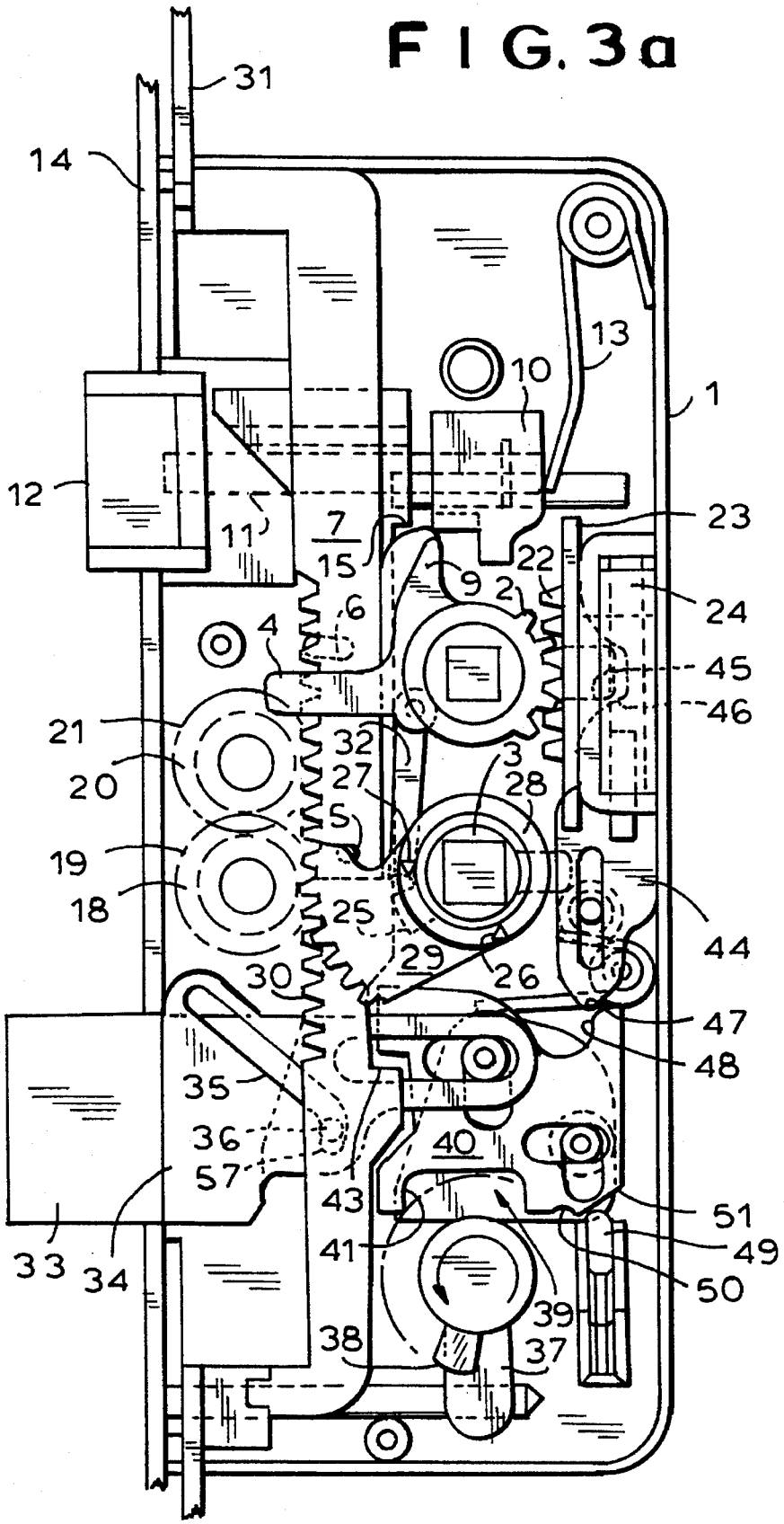
FIG. 3*a* is the lock of FIG. 1 in the locked position with the key lock engaged.
Figure 3B:
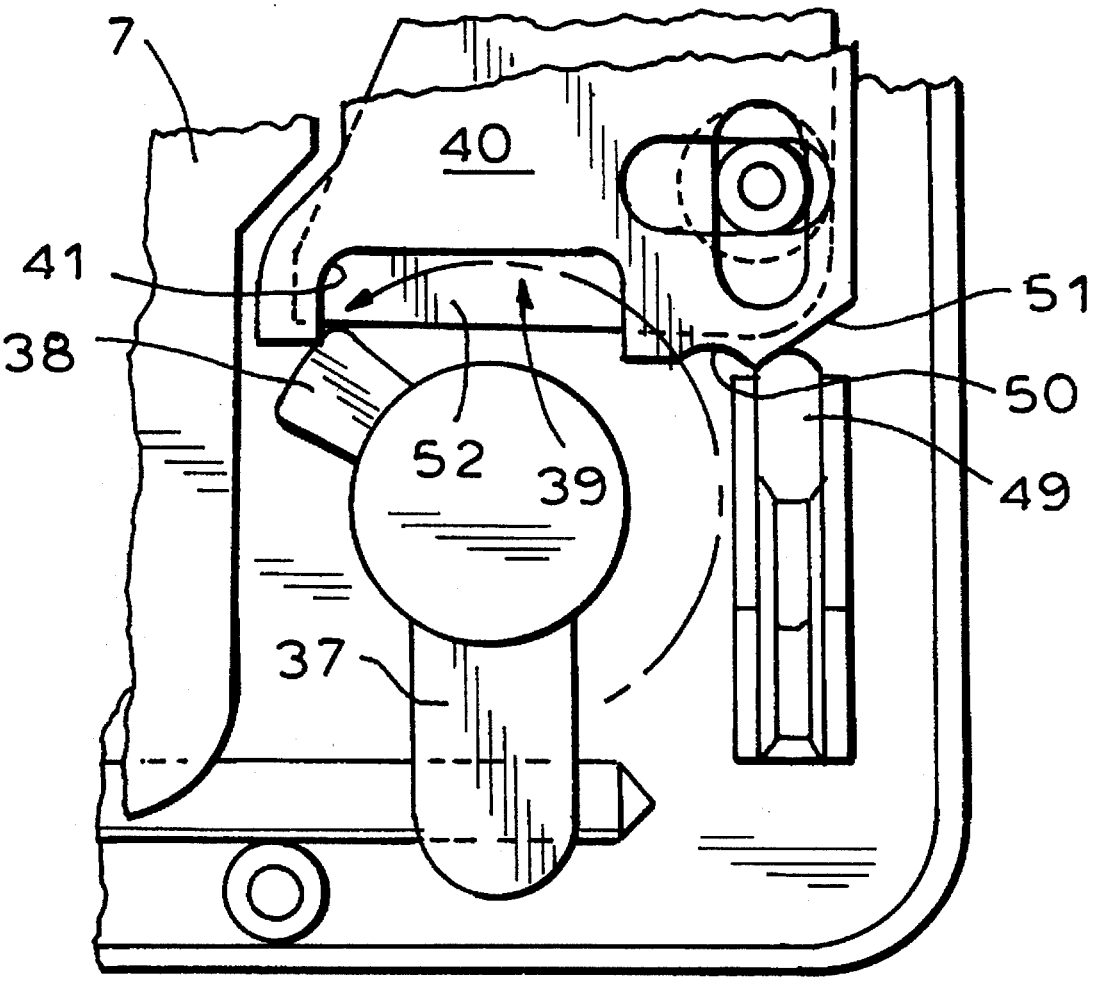
FIG. 3*b* is a large-scale view of a detail of FIG. 3*a*.

The outside-handle nut 3 has an entrainment formation or bump 25 that can engage either of two angularly spaced abutments or stops 26 and 27 on a ring 28 concentric with the nut 3 and carrying a toothed sector 29 meshing with the pinion 18. The difference between the angular dimension of the bump 25 and the angular spacing of the stops 26 and 27 works like the difference between the angular dimension of the arm 4 and the spacing of the stops 5 and 6 to form a lost-motion coupling that only couples the two parts 3 and 28 together after some angular travel, here about 45°, of the part 3. Thus when an outside handle 54 coupled to the nut 3 is lifted through 45° the sector gear 29 starts to move down so that the gears 18 and 19 rotate clockwise and the gears 20 and 21 counterclockwise. This moves the rods 8 and 31 apart into the locked position of FIGS. 2 and 3*a*. A spring-loaded centering system, like the teeth 22, rack 23, and spring 24, can be provided for the nut 3 also.

A link 32 has one end fixed on the nut 2 and an opposite end engageable with the actuating formation 25 of the nut 3. Thus when the outside handle 54 is moved down to rotate the nut 3 clockwise the link 32 is lifted to rotate the arm 9 clockwise and thereby pull back the bolt 12. In this manner pushing down either handle 53 or 54 will retract this bolt 12. The link 32 acts as a one-way coupling in that upward movement of the outside handle 54 will not move the inside handle 53.

Below the spring-loaded side bolt 12 is another side bolt 33 whose inside shaft 34 is formed with an angled slot 35 in which engages a pin 36 carried on the slide 7. Thus when one of the handles 53 or 54 is lifted, the slide 7 will move downward and the pin 36 will slide down in the slot 35, camming the bolt 33 outward into the position of FIG. 2. At its lower end the slot 35 has a section 57 that extends parallel to the vertical direction of displacement of the slide 7 and perpendicular to the horizontal direction of displacement of the bolt 33 so that the bolt 33 cannot be forced back into the housing 1 when the slide 7 is all the way down.

A key-operated cylinder 37 has an actuating arm 38 that can fit in a notch 39 of a slide 40 having a nose 42 engageable in a notch detent 43 of the slide 7. When the cylinder 37 is turned with the latch in the locked position of FIG. 2, the arm 38 engages an outer edge 41 of the notch 40 and pushes the slide 42 to the left, into the position of FIG. 3*a*. The nose 42 fits into the notch 43 and thereby holds the parts in the locked position. The slide 7 can have another such recess somewhat below the recess 43 to allow the latch to be locked in the unlocked position of FIG. 1, making it impossible for the door to be locked without the use of a key.

It is possible to open the door from inside, even when it has been locked with the key cylinder 37, by depressing the inside handle 53. To this end a vertical emergency-release slide 44 is provided in this housing 1 which has a cam edge 47 that can engage an edge 48 of the locking slide 40. This slide 44 has a hole 45 in which engages another radial arm 46 of the inside nut 2 so that when the inside nut is pivoted clockwise, the slide 44 moves down and cams back the lock slide 40. As soon as the nose 42 is clear of the seat 43, the lever 4 of the nut 2 will engage the stop 6 and raise the slide 7, thereby retracting the bolts 56 and 33.

In order to define stable positions for the lock slide 40, a spring-loaded pin 49 bears upward against a lower edge of the slide 40 that is formed with a notch 50 in which the pin lies in the unlocked (FIGS. 1 and 2) position of the slide and an angled surface 51 against which it lies in the locked position (FIGS. *3a* and *3b*). Furthermore the recess 39 of the lock slide 40 is provided with a spring plate 52 against which the cylinder cam 38 engages when it reaches into this recess 39. This prevents the cam 38 from sitting in the recess in a position holding the lock locked. In fact normally the cylinder 37 is normally constructed so that its unillustrated key, which can only be inserted from outside the door, can only be withdrawn when the cam 38 is directed downward, out of the recess 39.

I claim:

1. A door lock comprising:

a housing adapted to be mounted on an edge of the door;

inside and outside nuts rotatable about respective inside and outside axes on the housing;

respective inside and outside handles fixed to the nuts and respectively projecting inward and outward from the door, each handle being movable upward and downward from a central position;

a pair of bolt-actuating slides in the housing each movable between an outer position and an inner position;

respective bolts coupled to the slides and movable jointly therewith between a position extended from the door in the outer position of the respective slide and a position recessed in the door in an inner position of the respective slide;

an actuating arm on the inside nut;

stops on one of the slides flanking the inside-nut arm and coupling the arm to the one slide;

means including a gear train meshing on one side with the outside nut and on the other side with both of the slides for opposite movement of the two slides on rotation of the outside nut;

respective inside and outside lost-motion couplings between the inside nut and the one slide and between the outside nut and the gear train for permitting limited angular movement of the inside and outside nuts without movement of the one slide and gear train, the outside lost-motion coupling comprising a radial formation on the outside nut, and a ring rotatable on the outside nut and having a pair of angularly spaced stop surfaces engageable with the formation and spaced apart by a distance permitting the formation to move through a predetermined angle between a position contacting one of the stop surfaces and a position contacting the other stop surface; and means urging the nuts and handles into the central positions.

2. The multiple-bolt lock defined in claim 1 wherein the inside lost-motion coupling is formed by the stops which are spaced apart by a distance permitting the arm to move through a predetermined angle between a position contacting one of the stops to a position contacting the other stop.

3. A door lock comprising:

a housing adapted to be mounted on an edge of the door;

inside and outside nuts rotatable about respective inside and outside axes on the housing;

respective inside and outside handles fixed to the nuts and respectively projecting inward and outward from the door, each handle being movable upward and downward from a central position;

a bolt-actuating slide in the housing movable between an outer position and an inner position;

an outer bolt coupled to the slide and movable jointly therewith between a position extended from the door in the outer position of the slide and a position recessed in the door in an inner position of the slide;

a main bolt displaceable in the housing between a position extended from the door and a position recessed in the door and having an inner part juxtaposed with a part of the slide;

actuating means including an angled cam formation on one of the parts and a cam follower on the other part for displacing the main bolt outward into the extended position on displacement of the slide into the outer position;

a lock slide fittable with the bolt-actuating slide in a locked position retaining the bolt-actuating slide against movement between its positions;

means including an emergency-release slide coupled to the inside nut and displaceable by downward pivoting of the inside handle for engaging the lock slide and displacing it out of the locked position; and a key-operated cylinder coupled to the lock slide for moving it into the locked position.

4. The lock defined in claim 3 wherein the lock slide is formed with a lateral recess and the cylinder has a cam arm engageable in the recess.

5. The lock defined in claim 4 wherein the lock slide is provided with a spring urging the cam arm out of the recess.

6. The lock defined in claim 3 wherein the emergency-release slide is formed with a laterally open recess and the inside nut has a radially extending arm projecting into this recess.

7. The lock defined in claim 3 wherein the emergency-release slide has an angled cam edge engageable with the lock slide.

8. The lock defined in claim 3, further comprising an outside lost-motion couplings between the outside nut and the arm for permitting limited angular movement of the outside nuts without movement of the one slide until the emergency slide has engaged the lock slide and moved it out of the locked position.

9. The lock defined in claim 3, further comprising means urging the inside nut and handle into the central position.

10. A door lock comprising:

a housing adapted to be mounted on an edge of the door;

inside and outside nuts rotatable about respective inside and outside axes on the housing;

respective inside and outside handles fixed to the nuts and respectively projecting inward and outward from the door, each handle being movable upward and downward from a central position;

a bolt-actuating slide in the housing movable between an outer position and an inner position;

an outer bolt coupled to the slide and movable jointly therewith between a position extended from the door in the outer position of the slide and a position recessed in the door in an inner position of the slide;

a main bolt displaceable in the housing between a position extended from the door and a position recessed in the door and having an inner part juxtaposed with a part of the slide;

actuating means including an angled cam formation on one of the parts and a cam follower on the other part for displacing the main bolt outward into the extended position on displacement of the slide into the outer position;

a lock slide fittable with the bolt-actuating slide in a locked position retaining the bolt-actuating slide against movement between its positions;

a key-operated cylinder coupled to the lock slide for moving it into the locked position; and means for urging the inside nut and handle into the central position and comprising a sector gear formed on the inside nut, a displaceable rack meshing with the sector gear, and at least one spring braced between the rack and the housing and urging the rack into a position corresponding to the central position of the inside handle.

* * * * *